US005690332A

United States Patent [19]

Rechs

[11] Patent Number: 5,690,332

[45] Date of Patent: Nov. 25, 1997

[54] BOARD GAME AND PLAYING METHOD

[76] Inventor: Glenn M. Rechs, 913 Ridgeview, Pineville, La. 71360

[21] Appl. No.: 649,949

[22] Filed: May 14, 1996

[51] Int. Cl.[6] ..... A63F 3/02

[52] U.S. Cl. ..... 273/260; 273/291

[58] Field of Search ..... 273/260, 261, 273/262, 255, 288, 290, 291

[56] References Cited

U.S. PATENT DOCUMENTS

| | | | |
|---|---|---|---|
| 91,233 | 6/1869 | Hyatt, Jr. | 273/291 |
| 479,915 | 7/1892 | Maxwell | 273/291 X |
| 1,509,678 | 9/1924 | Macpherson . | |
| 1,525,944 | 2/1925 | Marteka | 273/260 |
| 1,529,987 | 3/1925 | Buker | 273/260 |
| 3,588,114 | 6/1971 | Vogel | 273/260 |
| 3,642,286 | 2/1972 | Moore | 273/260 |
| 3,897,953 | 8/1975 | Hovnanian | 273/260 |
| 3,902,724 | 9/1975 | Hersey | 273/290 X |
| 3,905,601 | 9/1975 | Tindall | 273/290 X |
| 3,989,253 | 11/1976 | Schifman | 273/260 |
| 3,993,313 | 11/1976 | Tillotson | 273/290 X |
| 4,227,696 | 10/1980 | Silverman | 273/260 |
| 4,497,491 | 2/1985 | Holman | 273/290 X |
| 4,506,893 | 3/1985 | Perry | 273/260 |
| 4,700,951 | 10/1987 | Lachenmeier et al. | 273/290 X |
| 4,938,482 | 7/1990 | Ludwick | 273/260 |
| 5,443,270 | 8/1995 | Loritz | 273/290 |

FOREIGN PATENT DOCUMENTS

| | | | |
|---|---|---|---|
| 16270 | 9/1892 | United Kingdom | 273/290 |

*Primary Examiner*—William E. Stoll
*Attorney, Agent, or Firm*—John M. Harrison

[57] ABSTRACT

A board game including in a preferred embodiment, a standard checker board and game pieces, each characterized by a negative or concave image of a dragon footprint on one face of the game piece and a positive or convex dragon footprint image on the opposite face of the game piece. The game is played by two teams or players, and one player lines his or her game pieces up on his or her base line of the game board, with the positive or convex image facing upwardly and the opposite player lines his or her game pieces up on the opposite base line of the game board, with the negative or concave side of the game piece facing upwardly. Each player moves a game piece forward on the board, until a negative game piece and a positive game piece face each other, at which point either a block occurs or a negative game piece may jump over a positive game piece or vice-versa, in the forward diagonal direction. When this occurs, both game pieces reverse "polarity", with the negative game piece inverted to a positive game piece and the positive game piece inverted to a negative game piece. Neither game piece involved in a jumping action may be moved by either player for one full turn and a "stalemate" or neutralization occurs in the game when the player or team whose turn it is, may not make a legal move. The first player or team to reach such a stalemate loses the game.

20 Claims, 1 Drawing Sheet

BOARD GAME AND PLAYING METHOD

BACKGROUND OF THE INVENTION

1. Field of the Invention

This invention relates to a board game such as checkers or chess and more particularly, to a new board game and method for playing the board game. In a preferred embodiment the game includes a conventional or standard checker board, characterized by eight rows and eight columns defining a grid characterized by sixty-four playing squares. The game includes sixteen game pieces, each typically characterized by a positive face which has a positive or convex image of a dragon footprint and a negative face which has a negative or concave image of the dragon footprint. Each player typically receives eight game pieces, and one player places his or her game pieces on the eight squares of his or her base line with the positive face or convex image facing upwardly, while the opposite player places his or her game pieces on his or her base line with the negative face or concave image facing upwardly. The players take turns moving one of his or her game pieces forward, one square at a time in each column, until a "block" occurs, or a positive game piece is adjacent to a negative game piece in the same column. A positive game piece can jump a negative game piece, or vice-versa, in the diagonal direction only from one column to another and when this jumping action occurs, both the jumping game piece and the jumped game piece change "polarity", or the negative game piece is inverted to a positive game piece and the positive game piece inverted to a negative game piece. Neither the jumped game piece nor the jumping game piece may be moved again until each player has completed a turn. After this time, the negative game piece is moved by the player controlling the negative game pieces, and vice-versa. When a negative game piece has been moved completely across the board to the opposite positive base line, that game piece is inverted to a positive game piece and is controlled by the positive game piece player. Similarly, after a positive game piece has been moved completely across the board to the negative base line or row, that game piece is inverted to a negative position and controlled by the negative game piece player. A "stalemate" or neutralization finally occurs when the player or team whose turn it is cannot make a legal move. Accordingly, the first player or team who is unable to make such a legal move loses the game.

2. Description of the Prior Art

Many games utilizing a checker board or a similar game board, are known in the art. U.S. Patent No. 1,509,678, dated Sep.23, 1924, to John F. MacPhearson et al, discloses a "Game" characterized by a board upon which the representation of a game of pool may be played by two or more players. U.S. Pat. No. 1,525,944, dated Feb. 10, 1925, to Anthony Marteka, details a "Game Called Rancho", which is similar to the game of checkers and utilizes a top for the board to regulate and direct the single moves of checkers or chips on the board. U.S. Pat. No. 1,529,987 dated Mar. 17, 1925, to Winnfield R. Buker et al, describes a "Game" which is a mathematical game involving permutation in the moves in such a manner as to stimulate both knowledge of and practice in certain fields of mathematics. A "Board Game Apparatus" is disclosed in U.S. Pat. No. 3,588,114, dated Jun. 28, 1971, to Charles B. Vogel. The game apparatus is characterized by game pieces which are associated with indicia to form an initially hidden permutation upon the board, which permutation is later changed to be perceptively distinguishable by all players during continuing portions of the game when revealed in a special manner. The hidden permutations may be formed in accordance with pre-agreed upon rules at the choice of individual players by corresponding adjustment of the individual game pieces. U.S. Pat. No. 3,642,286, dated Feb. 15, 1972, to Robert L. Moore, describes "Games With Changeable Playing Pieces", wherein each player has at least one playing piece for movement between positions designated on a playing surface. Identifying characteristics are provided for each piece for display on faces of the pieces with each piece having a plurality of such characteristics. A mechanism is provided for selecting a particular characteristic for each piece during operation of the game and depending upon the characteristics selected, the piece will have a variety of different powers from the standpoint of the number of spaces which can be moved during one turn of a player, the direction of movement possible and the ability of a piece to capture or be captured by another piece. Another "Board Game Apparatus" is disclosed in U.S. Pat. No. 03,897,953, dated Aug. 5, 1975, to John Hovnanian. Two opposing players manipulate playing pieces on a game board in such a way as to advance their own game pieces toward a goal, and at the same time, retard the advance of the opponent and eliminate opposing playing pieces. Still another "Game Board Apparatus" is disclosed in U.S. Pat. No. 3,989,253, dated Nov. 2, 1976, to Edward J. Schifman, in which the game board is similar to a checker board, with the two center rows of the game board replaced by a channel adapted for receiving two rows of vector tiles. The vector tiles alter the normal movement of the playing pieces on the game board, in that a game piece landing on a vector tile is constrained to move only in the directions indicated by the particular directional indicia on the top. U.S. Pat. No. 4,227,696, dated Oct. 14, 1980, to Irving Silverman, describes a "Board Game", including a game board having multiple playing areas which form diagonal rows. Multiple game pieces are positioned on the playing areas and are movable thereon. Each game piece includes an indicator which, when oriented in the direction of one of the rows toward a piece of the other set, places the latter piece under attack. U.S. Pat. No. 4,506,893, dated Mar. 26, 1985, to Mark E. Perry, details a "Method of Playing A Game In Which Playing Pieces Are Inverted", including a game board subdivided into eight rows and eight columns of uniformly dimensioned squares, each provided with a numeral such that the squares appear to be randomly numbered. Multiple playing pieces are coded such that each playing piece has a top half and a bottom half. Jumping an opponent's piece results in inversion of the jumped piece and the inverted piece may gain its original, upright position by jumping an opponent's piece. An inverted piece must be removed from the board if it is jumped twice. The game is won by either capturing by jumping one's opponent's game pieces or by successfully arranging three of one's own playing pieces in contiguous linearly-aligned relationship with respect to one another on an opponent's back row. Another "Board Game" is disclosed in U.S. Pat. No. 4,938,482, dated Jul. 3, 1990, to John H. Ludwick, et al. The game board is divided into eight rows and eight columns which define sixty-four squares. The squares are assigned values such that the sum of the valued spaces contained in the middle four rows of the board is greater than the sum of the valued spaces in the first two and last two rows of the board, to promote aggressive movement toward the center of the board. Points are awarded during play for movement of playing pieces upon the valued spaces of the board and for jumping the opponents playing pieces.

An object of this invention is to provide a board game which provides an unusual contest of skill, observation and wit.

Another object of this invention is to provide a new board game which utilizes in a preferred embodiment, a standard sixty-four square checker board and includes multiple game pieces which are moved over the surface of the board by two opposing players or teams.

Still another object of this invention is to provide a board game and method of playing a board game, wherein game pieces are moved over the surface of a game board having a selected number of playing spaces, by two opposing players who "jump" their game pieces diagonally over the opposing players game pieces, in order to change control of the game pieces involved in the jump.

Yet another object of this invention is to provide a board game having multiple game pieces which are moved over the surface of a game board of selected design by two opposing teams or players, wherein each opposing player "jumps" his or her game pieces diagonally over the game pieces of the opposing player from one column to another, in order to temporarily "freeze" or inactivate the moving action of each game piece involved in the jump.

Another object of this invention is to provide a board game for playing by two teams or players on a standard sixty-four square checker board or a board of selected design, wherein sustained game play results in an eventual stalemate or "neutralization" of the game pieces on the game board by one of the players and the game is lost by the player first encountering the stalemate.

Still another object of this invention is to provide a board game played on a game board having eight rows and seven columns, wherein the first player or team to encounter stalemate or neutralization of his or her game pieces loses the game.

SUMMARY OF THE INVENTION

These and other objects of the invention are provided in a new board game which provides an unusual contest of skill, observation and wit between two teams or players. In a preferred embodiment the game includes sixteen game pieces, eight of which are moved across the eight columns, respectively, of a standard sixty-four square checker board by one of the teams or players and the remaining eight being moved on the respective columns of the game board by the opposite team or player. In another preferred embodiment each game piece is characterized by a positive face having a convex or raised image, such as a dragon footprint and a negative face which has a concave image or depression, such the dragon footprint. One of the teams or players lines up his or her game pieces in the respective columns on his or her side of the game board, with the positive face of each game piece facing upwardly and the opposite team or player lines up his or her game pieces in the game board columns on his or her side of the game board, with the negative face of each game piece facing upwardly. Each team or player takes turns advancing selected ones of his or her game pieces toward the game pieces of the other in the respective columns and when two game pieces of opposite faces advance to a frontal position with respect to each other, a "block" occurs and neither game piece can move unless a jump becomes possible. A positive face game piece may jump an adjacent negative face game piece and vice-versa, in the diagonal direction only, from one column to another. And when this jumping action occurs, each game piece involved in the jump changes "polarity", with the negative game piece inverted to a positive piece and vice-versa. The two game pieces involved in such a jump cannot then be moved by either player until each player has completed a turn. A bar tag may be placed temporarily over the game pieces involved in the jump to remind the players of the "frozen" status of these game pieces. As the game progresses and more game pieces are involved in jumping actions, a stalemate or neutralization of all of the game pieces of one of the teams or players occurs sooner or later, and the first team or player to face this neutralization loses the game.

BRIEF DESCRIPTION OF THE DRAWINGS

The invention will be better understood by reference to the accompanying drawings, wherein.

DESCRIPTION OF THE PREFERRED EMBODIMENTS

Figure 4:
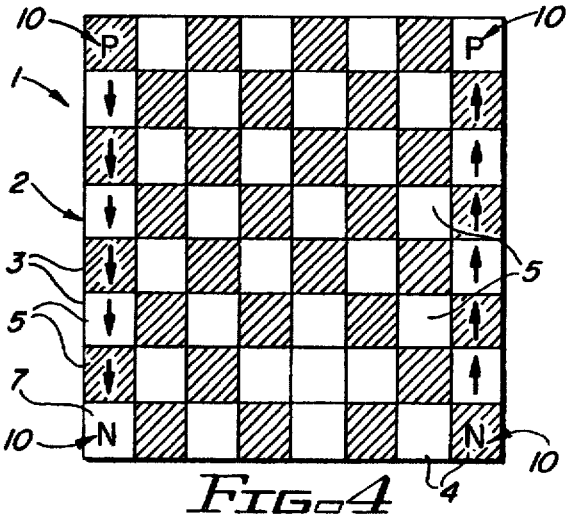
FIG. 4 is a top view of the game board illustrated in FIGS. 1–3, illustrating complete traversal of positive and negative game pieces to opposite sides of the board in the end columns, respectively, and change in polarity or inversion of the respective game pieces at the end of traversal.
Figure 5:
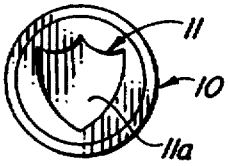
FIG. 5 is a plan view of the positive face of a typical game piece element of the invention.
Figure 6:
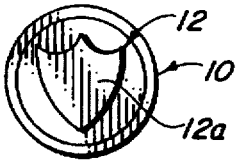
FIG. 6 is a plan view of the negative face of the game piece illustrated in FIG. 5.
Figure 7:
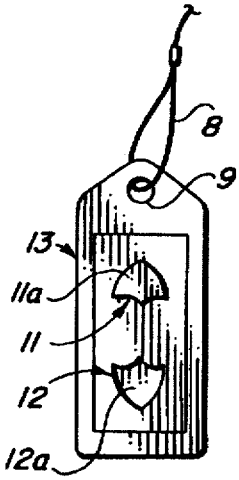
FIG. 7 is a perspective view of a bar tag for positioning over temporarily "frozen" playing pieces.

Referring initially to FIGS. 1–6 of the drawing, in a preferred embodiment the board game of this invention is generally illustrated by reference numeral 1. The board game 1 includes a game board 2, typically characterized by a standard checker board having eight rows 3, and eight columns 4, the latter traversing the game board 2 at right angles to the rows 3. The game board 2 includes a positive base row 6 along one playing edge and a negative base row 7 along the opposite edge and is divided into sixty-four playing squares 5, which alternate in light and dark colors in conventional fashion. As illustrated in FIGS. 5 and 6, each circular game piece 10 includes a positive face 11, having a raised or convex image **11*a*, and a negative face 12, having a depressed or concave image 12*a* on the opposite side of the game piece 10. In a most preferred embodiment of the invention the convex image 11*a* and concave image 12*a* are shaped to define a simulated dragon's foot. As illustrated in FIG. 7, a game piece bar tag 13 includes both a convex image 11*a* and a concave image 12*a* and may be attached to a bag or sack (not illustrated) upon which the game board 2 is imprinted, by means of a drawstring 8, extending through a drawstring opening 9**. In another embodiment, the game board 2 is divided into two sections by a center line 14 to highlight the respective territories of each team or player, as illustrated in FIG. 8.

Figure 1:
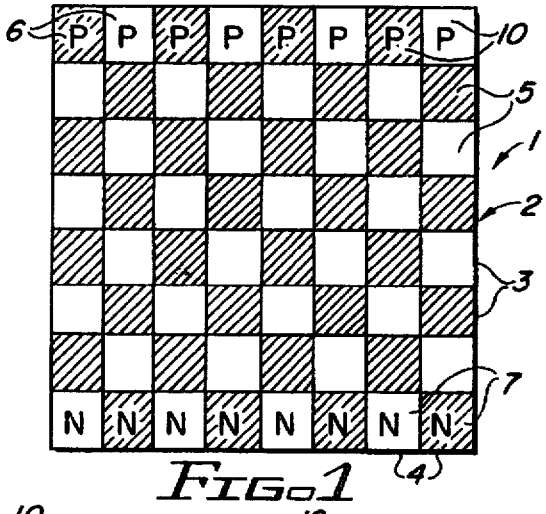
FIG. 1 is a top view of a typical game board of the game of this invention, with the game pieces of the game arranged in proper playing array or position in the respective board columns prior to the beginning of a game.
Figure 2:
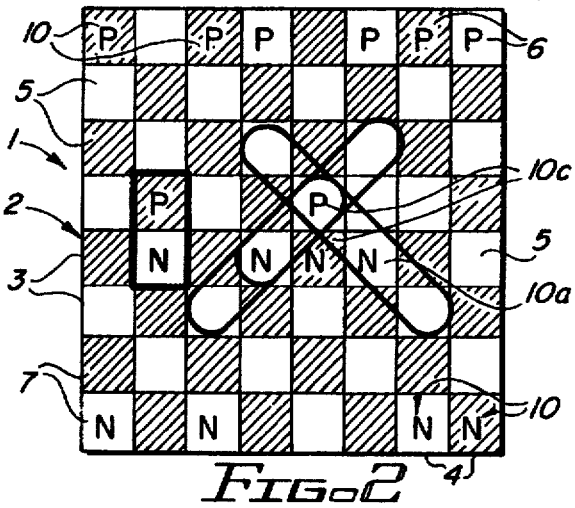
FIG. 2 is a top view of the game board illustrated in FIG. 1 after several moves of the game pieces in the columns by each player, and more particularly illustrating a "block" of two game pieces, in addition to possible jumps of adjacent game pieces which may be made according to the positioning of the game pieces on the game board.
Figure 3:
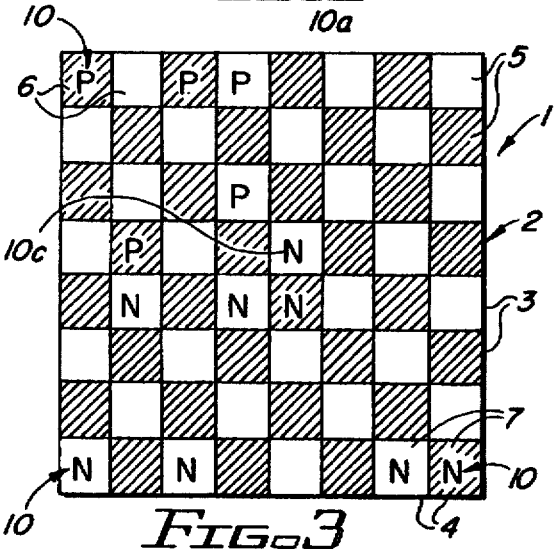
FIG. 3 is a top view of the game board illustrated in FIGS. 1 and 2, more particularly illustrating a jumping action made by one game piece over an adjacent game piece in another column and further illustrating the change in "polarity", or inversion, of each game piece involved in the jump.

Referring now to FIGS. 1–4 of the drawing, the game 1 is played by two teams or players positioned on opposite sides of the game board 2. Each team or player receives eight game pieces 10, and one of the players initially lines up his or her game pieces 10 on the positive base row 6 located adjacent to the edge of his or her side of the game board 2 in the respective columns 4, with the positive face 11 and convex image 11a of each of his or her game pieces 10, illustrated by the letter "P", facing upwardly, as illustrated. Similarly, the opposite player initially lines up his or her game pieces 10 on the negative base row 7, also in the columns 4, with the negative face 12 and concave image 12*a* of each game piece 10, illustrated by the letter "N", facing upwardly. To begin play, a coin (not illustrated) or game piece 10 is tossed into the air and one of the two faces of the coin or game piece 10 determines which player makes the first move. The beginning player then moves a selected game piece 10 on the game board 2, down the corresponding column 4, one playing square 5 at a time. As illustrated in FIG. 2, after several playing turns, a negative game piece 10 and positive game piece 10 may directly face each other in the same columns 4, resulting in two blocked game pieces 10*c*, which cannot move any further on the game board 2 unless a jump becomes possible. When one game piece 10 is located in diagonally-adjacent relationship with respect to another game piece 10, as illustrated, a jumping game piece 10*a* may jump over a blocked jumped game piece 10*c*. Accordingly, as illustrated by the arrow in FIG. 3, in this event, the jumping game piece 10*a* and blocked jumped game piece 10c each change "polarity", or become inverted, such that the previously negative jumping game piece 10*a* now becomes positive and the previously positive blocked jumped game piece 10*c* becomes negative. As illustrated in FIG. 4, if a positive or negative game piece 10 advancing in a column 4 from the positive base row 6 or negative base row 7, respectively, does not become blocked or does not jump another game piece 10 or become jumped by another game piece 10, and advances all the way to the opposite positive base row 6 or negative base row 7, then after reaching the opposite positive base row 6 or negative base row 7, that game piece 10 changes polarity from positive to negative or from negative to positive, as the case may be, and is controlled and moved by the corresponding player. Eventually, after an indeterminate number of turns taken by each player, all of one of the players game pieces 10 will be "neutralized" or unable to move to another position on the game board 2, either due to blocking or jumping, or both, and a stalemate occurs. The first player who achieves the neutralization or stalemate of his or her opponent, wins the game.

Figure 8:
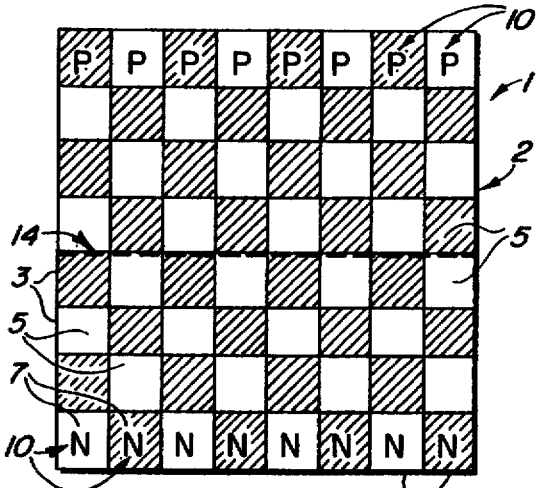
FIG. 8 is a top view of an alternative embodiment of the game board of this invention, with the game pieces arrayed in playing configuration as illustrated in FIG. 1.

Referring now to FIGS. 7 and 8 of the drawing, the bar tag 8 may be placed over two "frozen" game pieces 10 involved in a jumping action, to remind the players that these game pieces 10 may not be moved on the game board 2 by either player for one complete turn of both players.

It will be appreciated by those skilled in the art that the game board 2 may be designed for play using a selected number of rows 3 and columns 4 to suit the desires of the players. For example, a travel version of the board game 1 typically utilizes a game board 2 having eight columns 4 and seven rows 3, for a total of 56 playing squares 5. Furthermore, the positive faces 11 and negative faces 12 of the game pieces 10 may be so identified by color, markings or indicia other than the convex image 11*a* and concave image 12*a* described above. Moreover, the boardgame 1 can be computerized and developed electronically according to the knowledge of those skilled in the art and the game board 2 may contain any desired number of playing squares 5, whether the game is played conventionally or electrically. A preferred name for the game is "Ooglah's Dragon" (or "O.D.D.") Draught.

While the preferred embodiments of the invention have been described above, it will be recognized and understood that various modifications may be made in the invention and the appended claims are intended to cover all such modifications which may fall within the scope and spirit of the invention.

Having described my invention with the particularity set forth above, what is claimed is:

1. A game board comprising a grid having a selected number of rows and a selected number of columns defining a selected number of squares to identify a field of play; two sets of playing pieces disposed for movement on said grid, said playing pieces characterized by a substantially flat first surface and first indicia elevated from said first surface and a substantially flat second surface opposite said first surface and second indicia recessed in said second surface, wherein said playing pieces are placed on said grid with at least one said first surface and at least one said second surface facing said grid and said playing pieces are caused to traverse said squares on said grid.

2. The game board of claim 1 wherein said selected number of rows comprises eight rows, said selected number of columns comprises eight columns and said selected number of squares comprises sixty-four squares.

3. The game board of claim 1 comprising bar tag means for selectively covering selected sets of said playing pieces.

4. The game board of claim 1 comprising bar tag means for selectively covering selected sets of said playing pieces and wherein said selected number of rows comprises eight rows, said selected number of columns comprises eight columns and said selected number of squares comprises sixty-four squares.

5. The game board of claim 1 comprising board dividing indicia substantially horizontally bisecting said columns on said grid for dividing said field of play for said playing pieces on said grid.

6. The game board of claim 5 wherein said selected number of rows comprises eight rows, said selected number of columns comprises eight columns and said selected number of squares comprises sixty-four squares.

7. The game board of claim 5 comprising bar tag means for selectively covering selected sets of said playing pieces.

8. The game board of claim 5 comprising bar tag means for selectively covering selected sets of said playing pieces and wherein said selected number of rows comprises eight rows, said selected number of columns comprises eight columns and said selected number of squares comprises sixty-four squares.

9. A game board comprising a grid having eight rows and eight columns defining 64 squares identifying a playing area; two sets of playing pieces disposed for movement on said grid, said playing pieces each characterized by a substantially flat first surface and first indicia elevated from said first surface and a substantially flat second surface opposite said first surface and second indicia recessed in said second surface, wherein said playing pieces are caused to traverse said squares on said grid with an equal number of said first surface and said second surface facing said grid.

10. The game board of claim 9 wherein said first indicia comprises a simulated dragon foot elevated from said first surface and said second indicia comprises a simulated dragon foot recessed in said second surface.

11. The game board of claim 9 comprising bar tag means for selectively covering selected sets of said playing pieces.

12. The game board of claim 9 comprising bar tag means for selectively covering selected sets of said playing pieces and wherein said first indicia comprises a simulated dragon foot elevated from said first surface and said second indicia comprises a simulated dragon foot recessed in said second surface.

13. The game board of claim 9 comprising board dividing indicia substantially horizontally bisecting said columns on said grid for dividing said field of play for said playing pieces on said grid.

14. The game board of claim 13 wherein said first indicia comprises a simulated dragon foot elevated from said first surface and said second indicia comprises a simulated dragon foot recessed in said second surface.

15. The game board of claim 13 comprising bar tag means for selectively covering selected sets of said playing pieces.

16. A method of playing a game comprising the steps of, providing a flat, two-dimensional game surface means having peripheral boundaries defined in the marginal edges thereof;

providing a plurality of game pieces divided into at least two different groups, said game pieces provided with indicia such that said groups of said game pieces are readily visually distinguishable;

deploying said groups of said game pieces on said surface means at opposite ones of said peripheral boundaries;

moving selected ones of said game pieces in said groups on said surface means from said peripheral boundaries, respectively, in a straight line, in alternating relationship from said groups, respectively;

jumping an opponent's game piece diagonally when two of said game pieces from said groups, respectively, oppose each other adjacently, on said straight line and at least one of said game pieces lies adjacent to another one of said game pieces diagonally on said surface means; and inverting said one of said game pieces which jumped said another one of said game pieces and inverting said another one of said game pieces jumped by said one of said game pieces, whereby the ownership of said one of said game pieces and said another of said game pieces is changed.

17. The method according to claim 16 comprising the step of placing a bar tag means on said one of said game pieces and said another of said game pieces for marking said jumping of said opponent's game piece.

18. The method according to claim 16 comprising the step of marking said game pieces, wherein said game pieces include a first flat surface and first indicia elevated from said first flat surface and a second flat surface and second indicia depressed in said second flat surface.

19. The method according to claim 16 comprising:

(a) the step of placing a bar tag means on said one of said game pieces and said another of said game pieces for marking said jumping of said opponent's game piece; and (b) the step of marking said game pieces wherein said game pieces include a first flat surface and first indicia elevated from said first flat surface and a second flat surface and second indicia depressed in said second flat surface.

20. The method according to claim 19 wherein said first indicia and said second indicia are a simulated dragon foot.

* * * * *